US006915605B2

(12) United States Patent
Lavoie

(10) Patent No.: US 6,915,605 B2
(45) Date of Patent: Jul. 12, 2005

(54) OVERLAY MANAGEMENT SYSTEM

(75) Inventor: Mark M. Lavoie, Simsbury, CT (US)

(73) Assignee: Reflexite Corporation, Avon, CT (US)

( * ) Notice: Subject to any disclaimer, the term of this patent is extended or adjusted under 35 U.S.C. 154(b) by 0 days.

(21) Appl. No.: 09/885,524

(22) Filed: Jun. 20, 2001

(65) Prior Publication Data

US 2002/0017046 A1 Feb. 14, 2002

Related U.S. Application Data

(60) Provisional application No. 60/213,012, filed on Jun. 21, 2000.

(51) Int. Cl.[7] ..... G09F 7/02

(52) U.S. Cl. ..... 40/612; 40/611.01; 40/620; 411/546

(58) Field of Search ..... 40/611.01, 611, 40/612, 615, 620, 622; 411/508, 913, 546

(56) References Cited

U.S. PATENT DOCUMENTS

| | | | | |
|---|---|---|---|---|
| 3,067,536 A | | 12/1962 | Brittsan | |
| 3,089,269 A | | 5/1963 | McKiernan | |
| 3,684,348 A | * | 8/1972 | Rowland | 264/1.9 |
| 4,161,834 A | | 7/1979 | Hendricks, Jr. | |
| 4,250,647 A | | 2/1981 | Woodard | |
| 4,852,284 A | | 8/1989 | Faggiano | |
| 5,050,828 A | | 9/1991 | Wolff | |
| 5,173,026 A | * | 12/1992 | Cordola et al. | 24/297 |
| 5,212,898 A | | 5/1993 | Dinan et al. | |
| 5,343,646 A | | 9/1994 | Cobb et al. | |
| 5,675,923 A | | 10/1997 | Sarkisian et al. | |
| 6,056,425 A | | 5/2000 | Appelberg | |

FOREIGN PATENT DOCUMENTS

| | | |
|---|---|---|
| DE | 295 00 906 U1 | 8/1995 |
| FR | 1.357.370 | 2/1964 |
| GB | 780445 | 7/1957 |

OTHER PUBLICATIONS

"Recommended Procedures for the Safety Performance Evaluation of Highway Features," (National Cooperative Highway Research Program *NCHRP Report 350*). Transportation Research Board, National Research Council (1993).

"Crash Worthiness of Workzone Appurtenances, *Action*: Identifying Acceptable Highway Safety Features," Federal Highway Administration memorandum (Feb. 1999).

* cited by examiner

*Primary Examiner*—William L. Miller
(74) *Attorney, Agent, or Firm*—Hamilton, Brook, Smith & Reynolds, P.C.

(57) ABSTRACT

A sign includes a main body having a first surface and a second surface and an overlay removably attachable to the first surface or the second surface of the main body, and at least two fasteners attached to the overlay for removably securing the overlay to the first surface or the second surface. Each fastener can pass through an oversized hole in the overlay and be movably secured to the overlay with a washer. Each washer spaces the overlay from the main body when the overlay is attached to the main body. The main body can include a plurality of hollow cells within the main body.

35 Claims, 5 Drawing Sheets

OVERLAY MANAGEMENT SYSTEM

RELATED APPLICATION

This application claims the benefit of U.S. Provisional Application No. 60/213,012, filed on Jun. 21, 2000, the entire teachings of which are incorporated herein by reference.

BACKGROUND OF THE INVENTION

Traditionally, many temporary construction work zone or traffic control signs are made of ⅝ inch to ¾ inch (16 to 19 millimeter) plywood. With such a material, the traditional method of changing a message is with an overlay, which changes at least a portion of the message, is to simply nail another piece of plywood over the original message and bend the nails over on the back side of the sign. This added piece of plywood nailed to the surface of the original sign creates several problems. First, it is difficult to remove the overlay when the overlay is not needed. Since the overlay is not easily removed, it stays with the sign when not in use. The extra thickness of the overlay creates difficulty when trying to stack many signs together. Furthermore, when several signs are stacked against each other, the bent over nails on the back of the sign with the overlay, destroys the costly retroreflective film on the face of the sign behind it.

SUMMARY OF THE INVENTION

The present invention is directed to an overlay system which eliminates these problems for signs made of any material. The overlay of this invention can be made of any relatively thin but tough and durable material, such as polycarbonate. In alternative embodiments, the overlay can include sheet metal, wood, fabric, fabric reinforced polyvinyl chloride, plastic, or polymeric film. The thinness of the overlay makes stacking of inactive signs much easier. This thinner overlay is attached to the main sign with refastenable fasteners which makes it much easier to remove. These fasteners can be made of any material which is suitably elastic or has such a structure that it can maintain gripping force when compressed into an appropriately sized hole. When the overlay is not needed on the front surface of the sign, it can easily be attached to the back surface of the sign for purposes such as storage. When the main sign is of an appropriate thickness, the fasteners do not protrude out the back of the sign to destroy the costly retroreflective film of another sign when stacked for storage. This method of attachment is particularly useful when the main sign is of a hollow-type construction.

In accordance with the invention, a sign is provided comprising a main body having a first surface and a second surface and an overlay removably attachable to the first surface or the second surface of the main body, and at least two fasteners attached to the overlay for removably securing the overlay to the first surface or the second surface. Each fastener can pass through an oversized hole in the overlay and be movably secured to the overlay with a washer. Each washer spaces the overlay from the main body when the overlay is attached to the main body. In one embodiment, the main body includes a plurality of hollow cells within the main body.

In one embodiment, the main body and the overlay include polycarbonate. In alternative embodiments, the main body includes at least one selected from the group of plywood, plastic, aluminum, and other substantially rigid material. The overlay can include at least one selected from the group of sheet metal, wood, fabric, fabric reinforced polyvinyl chloride, plastic, and polymeric film. Retroreflective sheeting can be disposed on the main body and the overlay for retroreflecting light back toward a light source. In one embodiment, the retroreflective sheeting includes a plurality of air-backed cube-corner prisms. In another embodiment, the retroreflective sheeting includes a plurality of cube-corner prisms each having three facets extending to an apex, wherein substantially all of the facets have a reflective coating thereon. In yet another embodiment, the retroreflective sheeting includes glass beads.

A barrier film, which can include polyester, can be disposed between the overlay and the retroreflective sheeting. A first adhesive can be disposed between the barrier film and overlay and a second adhesive can be disposed between the barrier film and the retroreflective sheeting.

The sign can include a slit on a back side and be formed from a substantially flexible material such that it can be folded in half. The sign can be mounted on a mounting device.

The overlay can be removably attachable to a back side of the main body, for example, for storage purposes.

Preferably, the fasteners snap-fit into the main body. Each fastener can include an expandable shank that passes through a hole in the main body to deform the shank, wherein the shank expands after passing through the hole to secure the overlay to the main body.

BRIEF DESCRIPTION OF THE DRAWINGS

The foregoing and other objects, features and advantages of the invention will be apparent from the following more particular description of preferred embodiments of the invention, as illustrated in the accompanying drawings in which like reference characters refer to the same parts throughout the different views. The drawings are not necessarily to scale, emphasis instead being placed upon illustrating the principles of the invention.

DETAILED DESCRIPTION OF THE INVENTION

Figure 1:
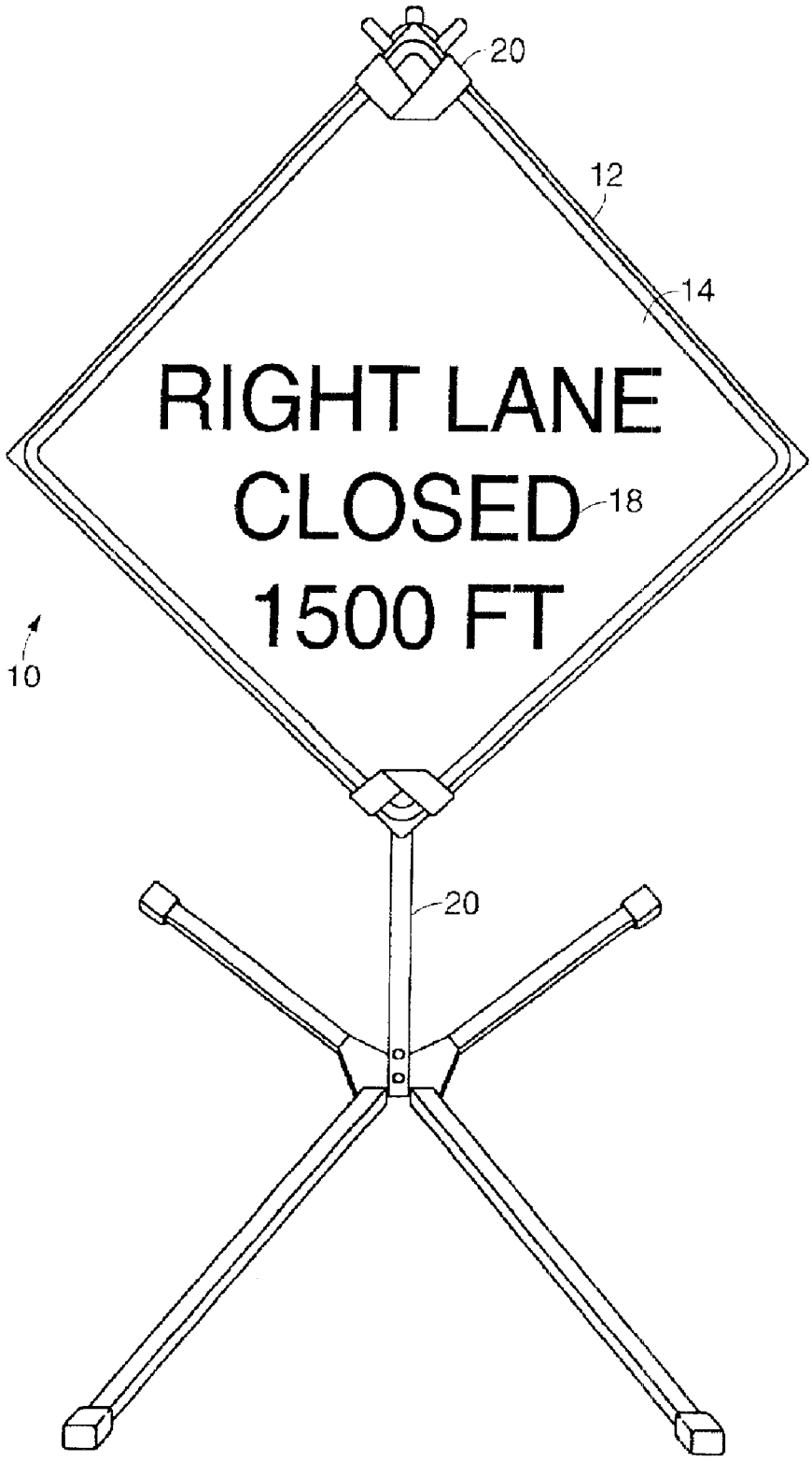
FIG. 1 is a perspective view of a sign in accordance with the present invention.
Figure 2:
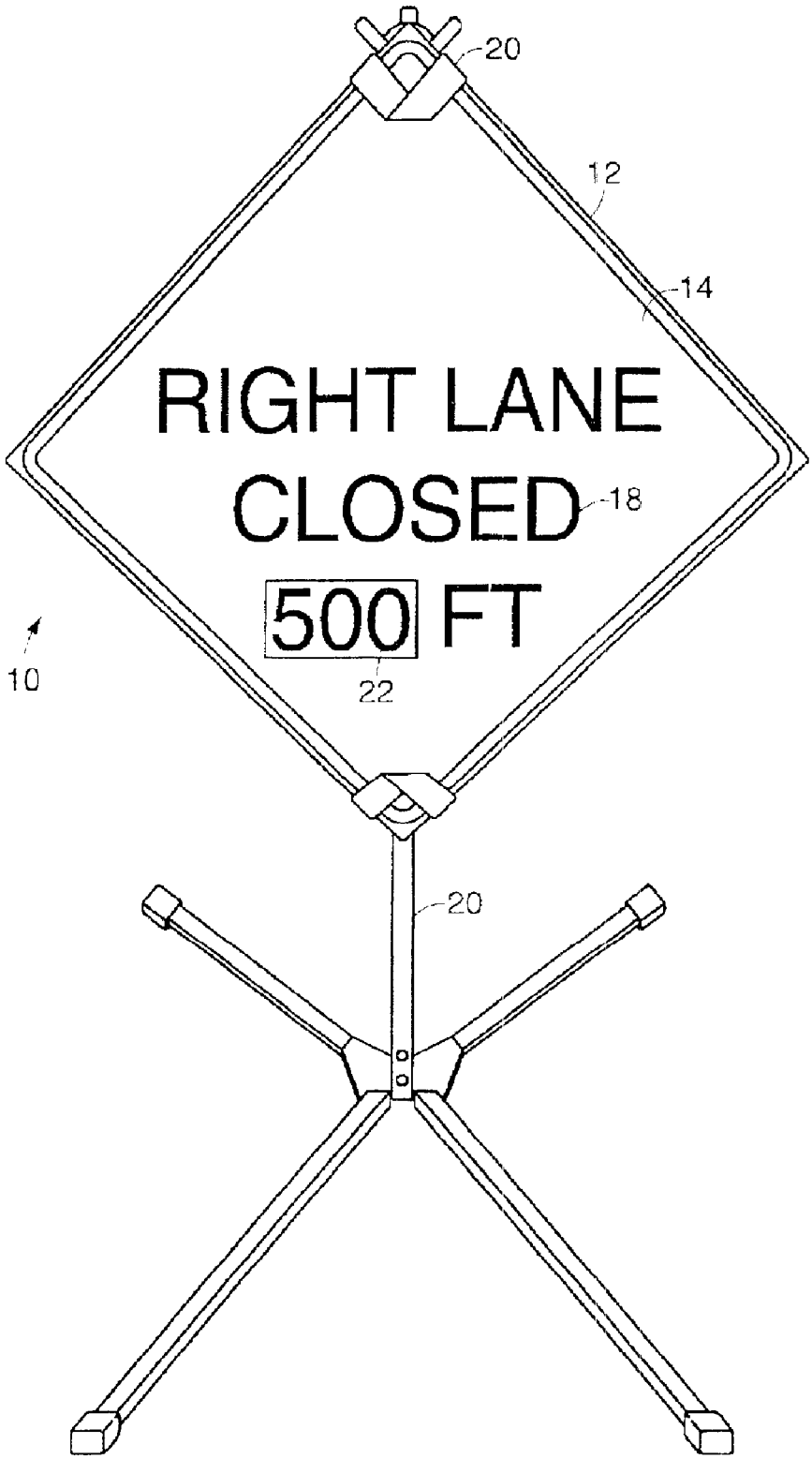
FIG. 2 is the sign of FIG. 1 having an inventive overlay disposed over a portion of the sign.

A description of preferred embodiments of the invention follows. FIG. 1 illustrates a sign 10 which includes a main body 12 that can have retroreflective sheeting 14 on a first or front surface 16 (shown in cross-sectional view in FIG. 3). The sign 10 includes lettering, images, or other indicia 18 used to convey a message, for example, to a passing motorist. In one embodiment, the sign 10 is mounted in place by a mounting device 20. FIG. 2 illustrates the sign 10 having an overlay 22 positioned over at least a portion of the main body 12 for changing all or some of the indicia 18.

Figure 3:
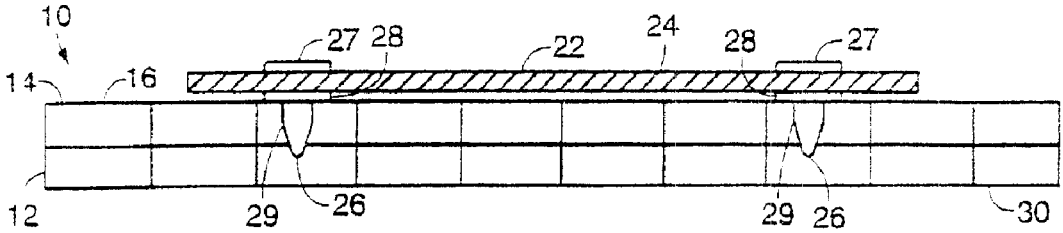
FIG. 3 is a partial cross-sectional view of the sign and overlay of FIG. 2.

FIG. 3 is a cross-sectional view of the sign 10. In one embodiment, the main body 12 and overlay 22 are made from a tough, durable thermoplastic which is also substantially resistant to degradation to outdoor ultraviolet exposure. In this embodiment, the components 12, 22 are formed from polycarbonate. Having all of the main components made of the same material reduces the impact of temperature changes as the thermal expansions and contractions are similar. In alternative embodiments, the main body 12 can include any substantially rigid material, such as plywood, plastic, or aluminum. The main body 12 of the sign 10 can be a multi-celled walled panel of extruded polycarbonate as shown in FIG. 3 to form a strong, lightweight structure. In alternative embodiments, the overlay 22 can include sheet metal, wood, fabric, fabric reinforced polyvinyl chloride, plastic, or polymeric film.

In one embodiment, the lightweight nature of the material that forms the sign 10 allows handling and mounting of these signs relatively easy compared to aluminum or plywood signs which are approximately two to three times the weight respectively. Further, the lightweight construction makes the sign 10 less likely to inflict serious damage to a motorist who hits it than conventional plywood signs. For further information on this subject, the reader is referred to The Intermodal Surface Transportation Efficiency Act of 1991 (ISTEA) and related documents which required the Secretary of Transportation to institute measures to enhance the crashworthy performance of roadside features to accommodate vans, mini-vans, pickup trucks, and four-wheel drive vehicles.

The overlay 22 can be a monolithic sheet of polycarbonate which, in one embodiment, is about 0.06 inches (1.52 mm) thick. A retroreflective sheeting 24 can be attached to the overlay 22 and/or the main body 12. An example of a suitable retroreflective sheeting is disclosed in U.S. Pat. No. 3,684,348, issued to Rowland on Aug. 15, 1972, the teachings of which are incorporated herein by reference. Other types of retroreflective sheeting can include glass beads. Generally, any suitable sheeting used in signage can be employed.

In one embodiment, the fasteners can include arrow clips 26 as illustrated in FIG. 3 and can be made of polycarbonate. The clips 26 pass through oversized holes in the overlay 22 and are movably secured to the overlay by washers 28. The washers 28 on the back side of the overlay 22 provide at least two other beneficial features both related to the fact that the washers hold the overlay off of the front surface 16 of the main body 12. First, the small space provided makes it easier to get the user's fingers under the edge of the overlay 22 to remove it from the main body 12. Second, the small space allows water and the like to drain out from behind the overlay 22 to resist material buildup, for example, ice and dirt. In one embodiment, the overlay 22 can be stored on a second surface or backside 30 of the main body 12 when not in use.

Figure 4:
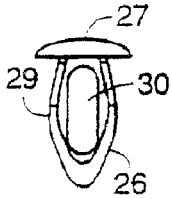
FIG. 4 is a side view of an exemplary fastener used to attach the overlay to the sign in accordance with the present invention.
Figure 5:
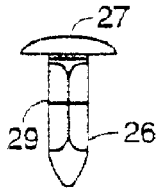
FIG. 5 is another side view of the exemplary fastener of FIG. 4 used to attach the overlay to the sign in accordance with the present invention.

FIGS. 4 and 5 are side views of the fastener 26 which includes a hollow area 30 which allows the fastener sides to flex when passing through holes in the main body to snap-fit therein. More particularly, each fastener 26 includes a head 27 having a shank 29 extending therefrom. The shank 29 is expandable such that it deforms while passing through a hole in the main body and expands after passing through the hole to secure the overlay 22 to the main body 12.

In alternative embodiments, the fasteners 26 can include any design that removably secures the overlay 22 to the main body 12. For example, the fasteners can include push-mounted blind rivets, tree rivets, push-in panel rivets, keyhole panel rivets, ratchet rivets, slam rivets, snap rivets, turn button fasteners, locking snap fasteners, truss-head split rivets, removable rivets, quarter-turn receptacles and studs, captive screws, button snaps, snap button studs, snap-in plunger-heads, or other suitable fasteners.

Figure 6:
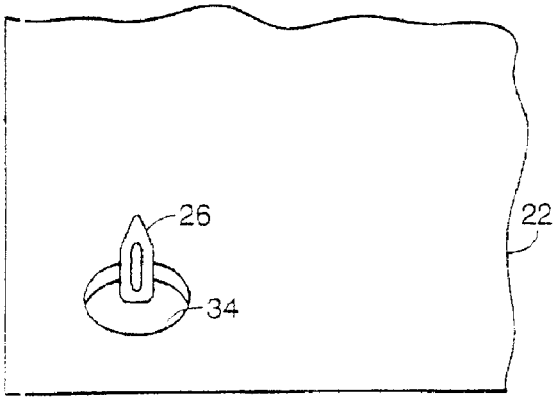
FIG. 6 is a perspective view of the backside of the overlay of FIG. 2 particularly illustrating an oversized hole in the overlay.
Figure 7:
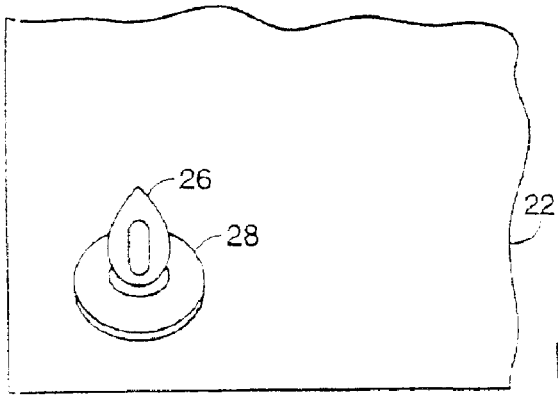
FIG. 7 is a perspective view of the backside of the overlay of FIG. 2 particularly illustrating a washer holding the fastener captive in the oversized hole.

FIG. 6 is a perspective view of the backside of the overlay 22 particularly illustrating the oversized hole 34 in the overlay. FIG. 7 illustrates the washer 28 holding the fastener 26 captive in the oversized hole 34 which allows the fastener to laterally move within the hole so that the fasteners can line up with respective holes, even if the holes are not exactly placed, for example, in a rectangle or square. In one embodiment, four fasteners 26 at the corners of the overlay 22 are used to secure the overlay to the main body 12, such as shown in FIG. 2.

Figure 8:
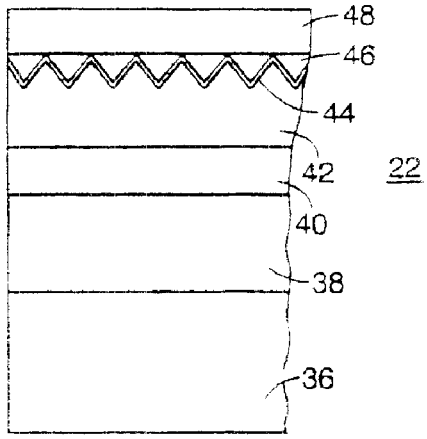
FIG. 8 is another cross-sectional view of the overlay of FIG. 2.

FIG. 8 is another cross-sectional view of the overlay 22. A substrate 36 supports a first adhesive 38 which binds a barrier film 40 to the substrate. In one embodiment, the barrier film 40 includes polyester, polyethylene, polypropylene, polystyrene or the like. The first adhesive 38 can include any adhesive which is specifically designed to bind the barrier film 40 to the substrate 36. On the opposite side of the barrier film 40 is a second adhesive 42 which can include a plasticizer resistant acrylic, which is specifically designed to attach a reflective coating 44, such as aluminum, of cube-corner prisms 46 to the barrier film 40. A substantially transparent surface film 48 is further provided to support the cube-corner prisms 46.

Figure 9:
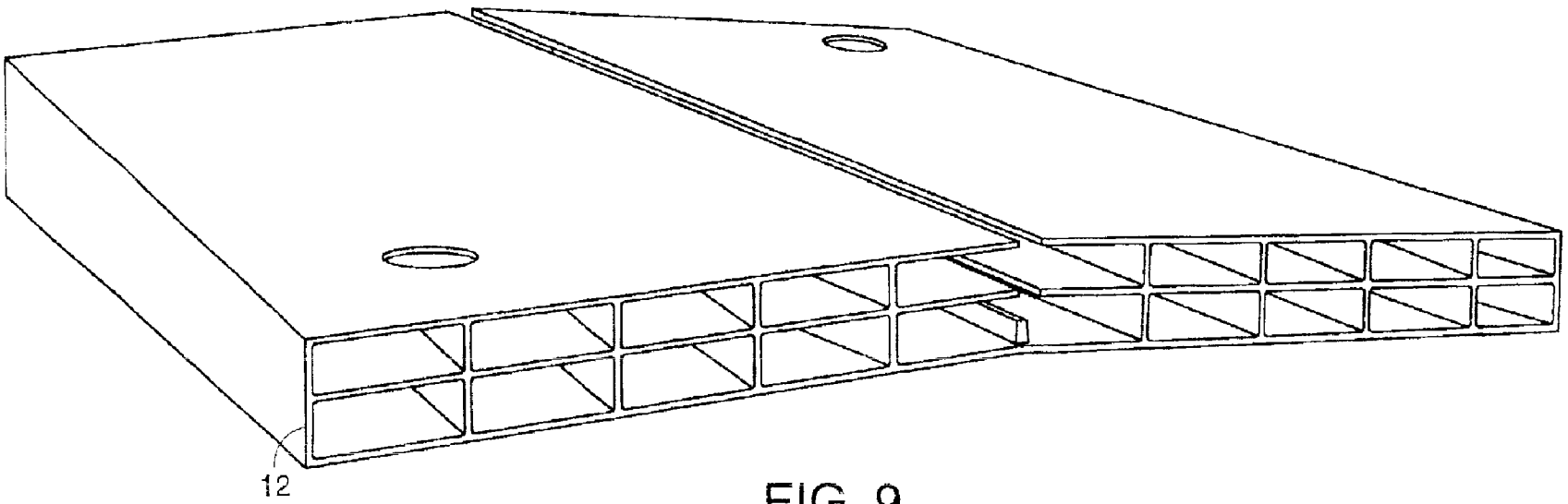
FIG. 9 illustrates the main body of the sign slit on one side such that the main body can be bent in half in accordance with the present invention.
Figure 10:
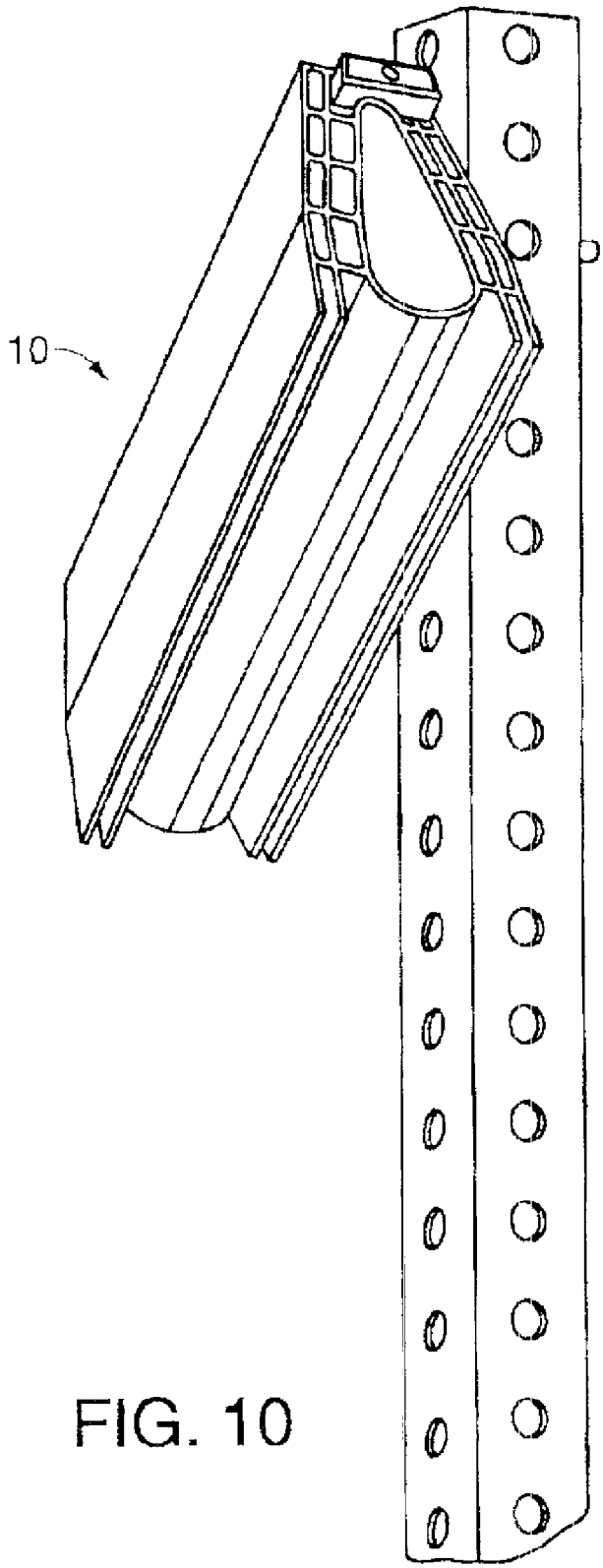
FIG. 10 illustrates the sign of FIG. 9 bent in half.

A known practice in construction work zone signage is to cut a sign in half and reconnect it with hinges at the cut edges, thereby creating a sign that can fold up upon itself rendering the sign out of service while the construction site is inactive. In accordance with the invention, FIG. 9 illustrates the main body 12 slit on one side such that the main body can be bent in half, as illustrated in FIG. 10. Thus, a "living hinge" is provided such that the sign 10 can be doubled over on itself to hide the indicia 18 from likely viewers without requiring the sign to be cut in half, and without requiring hinges.

While this invention has been particularly shown and described with references to preferred embodiments thereof, it will be understood by those skilled in the art that various changes in form and details may be made therein without departing from the scope of the invention encompassed by the appended claims.

What is claimed is:

1. A sign comprising:

a main body having a first surface and a second surface;

an overlay removably attachable to the first surface in a first position and the second surface in a second position of the main body; and at least two fasteners movably attached to the overlay for removably securing the overlay to the first surface or the second surface, each fastener passing through an oversized hole in the overlay and movably secured to the overlay with a removable washer, each washer spacing the overlay from the main body when the overlay is attached to the main body in the first position and the second position.

2. The sign of claim 1, wherein the main body includes at least one selected from the group of polycarbonate, plywood, plastic, and aluminum.

3. The sign of claim 1, wherein the overlay includes at least one selected from the group of polycarbonate, sheet metal, wood, fabric, fabric reinforced polyvinyl chloride, plastic, and polymeric film.

4. The sign of claim 1, further comprising a retroreflective sheeting disposed on the main body and the overlay for retroreflecting light back toward a light source.

5. The sign of claim 4, wherein the retroreflective sheeting includes glass beads.

6. The sign of claim 4, wherein the retroreflective sheeting includes a plurality of air-backed cube-corner prisms, each prism having three facets extending to an apex.

7. The sign of claim 4, wherein the retroreflective sheeting includes a plurality of cube-corner prisms each having three facets extending to an apex, wherein substantially all of the facets have a reflective coating thereon.

8. The sign of claim 4, further comprising a barrier film disposed between the overlay and the retroreflective sheeting.

9. The sign of claim 8, wherein the barrier film includes at least one selected from the group of polyester, polyethylene, polypropylene, and polystyrene.

10. The sign of claim 8, further comprising a first adhesive disposed between the barrier film and the overlay and a second adhesive disposed between the barrier film and the retroreflective sheeting.

11. The sign of claim 1, wherein the sign is slit on a back side and formed from a substantially flexible material such that it can be folded in half.

12. The sign of claim 1, wherein the sign is mounted on a mounting device.

13. The sign of claim 1, wherein the fasteners snap-fit into the main body.

14. The sign of claim 1, wherein each fastener includes an expandable shank that passes through a hole in the main body to deform the shank, wherein the shank expands after passing through the hole to secure the overlay to the main body.

15. The sign of claim 1, wherein the main body includes a plurality of hollow cells within the main body.

16. A sign comprising:

a main body having a first surface and a second surface and a plurality of hollow cells within the main body;

an overlay removably attachable to the first surface in a first position and the second surface in a second position of the main body; and at least two fasteners movably attached to the overlay for removably securing the overlay to the main body, each fastener passing through an oversized hole in the overlay and movably secured to the overlay with a washer, each washer spacing the overlay from the main body when the overlay is attached to the main body; wherein each fastener includes an expandable shank that deforms when passing through a hole in the main body and expands after passing through the hole to removably secure the overlay to the main body.

17. A sign comprising:

a main body having a first surface and a second surface;

an overlay removably attachable to the first surface in a first position and the second surface in a second position of the main body; and at least two fasteners for removably securing the overlay to the first surface and the second surface, the fasteners being movably attached to the overlay, each fastener being secured to the overlay with a removable washer, each washer spacing the overlay from the main body when the overlay is attached to the main body.

18. The sign of claim 17, wherein each fastener passes through an oversized hole in the overlay.

19. The sign of claim 17, wherein the main body includes a plurality of hollow cells within the main body.

20. A sign comprising:

a main body having a first surface and a second surface;

an overlay removably attachable to the first surface in a first position and the second surface in a second position of the main body; and at least two fasteners movably attached to the overlay for removably securing the overlay to the first surface and the second surface, each fastener passing through an oversized hole in the overlay and movably secured to the overlay with a removable washer, each washer spacing the overlay from the main body when the overlay is attached to the main body in the first position and the second position.

21. A method of providing an overlay on a sign comprising:

forming a main body having a first surface, a second surface, and a plurality of hollow cells within the main body; and removably attaching an overlay to the first surface in a first position and the second surface in a second position of the main body with at least two fasteners attached to the overlay, each fastener passing through an oversized hole in the overlay and movably secured to the overlay with a removable washer, each washer spacing the overlay from the main body when the overlay is attached to the main body.

22. The method of claim 21, further comprising providing a retroreflective sheeting on the main body and the overlay for retroreflecting light back toward a light source.

23. The method of claim 22, wherein the retroreflective sheeting includes a plurality of air-backed cube-corner prisms.

24. The method of claim 22, wherein the retroreflective sheeting includes a plurality of cube-corner prisms each having three facets extending to an apex, wherein substantially all of the facets have a reflective coating thereon.

25. The method of claim 22, further comprising providing a barrier film between the overlay and the retroreflective sheeting.

26. The method of claim 25, further comprising providing a first adhesive between the barrier film and overlay and further providing a second adhesive between the barrier film and the retroreflective sheeting.

27. The method of claim 21, further comprising folding the sign in half.

28. The method of claim 21, further comprising mounting the sign on a mounting device.

29. The method of claim 21, further comprising removably attaching the overlay to the second side of the main body.

30. A method of providing an overlay on a sign comprising:

forming a main body having a first surface and a second surface; and removably attaching an overlay to the first surface in a first position and the second surface in a second position of the main body with at least two fasteners attached to the overlay, each fastener passing through an oversized hole in the overlay and movably secured to the overlay with a removable washer, each washer spacing the overlay from the main body when the overlay is attached to the main body.

31. A method of providing an overlay on a sign comprising:

providing a main body having a first surface and a second surface;

providing an overlay that includes at least two oversized holes therein;

providing at least two fasteners and end of each fastener through each oversized hole in the overlay and attaching a removable washer to the distal end of each fastener to movably secure each fastener to the overlay; and attaching the overlay to the first surface and the second surface of the main body with the fasteners.

32. The method of claim 31, wherein the overlay does not cover substantially all of the first surface or the second surface of the main body.

33. The method of claim 31, wherein the distal ends of the fasteners extend into holes in the main body.

34. The method of claim 33, wherein the holes in the main body are not in a perimeter of the main body.

35. A sign comprising:

a main body having a first surface and a second surface;

an overlay removably attachable to the first surface in a first position and the second surface in a second position of the main body; and at least two fasteners movably attached first to the overlay for removably securing the overlay to the first surface or the second surface, each fastener passing through an oversized hole in the overlay and movably secured to the overlay with a removable washer, each washer spacing the overlay from the main body when the overlay is attached to the main body in the first position and the second position.

* * * * *

UNITED STATES PATENT AND TRADEMARK OFFICE

CERTIFICATE OF CORRECTION

PATENT NO. : 6,915,605 B2
DATED : July 12, 2005
INVENTOR(S) : Mark M. Lavoie

It is certified that error appears in the above-identified patent and that said Letters Patent is hereby corrected as shown below:

Column 7,
Line 13, insert between the word "and" and the word "end" the following:
-- inserting a distal --.

Signed and Sealed this

Fourth Day of October , 2005

JON W. DUDAS
*Director of the United States Patent and Trademark Office*